US005735344A

United States Patent [19]

Duncan

[11] Patent Number: 5,735,344

[45] Date of Patent: Apr. 7, 1998

[54] TUBING HANGER WITH HYDRAULICALLY ENERGIZED METAL ANNULAR SEAL WITH NEW DESIGN TUBING HANGER RUNNING TOOL

[75] Inventor: Neil S. Duncan, Fife, Scotland

[73] Assignee: FMC Corporation, Chicago, Ill.

[21] Appl. No.: 654,501

[22] Filed: May 28, 1996

[51] Int. Cl.[6] ..... E21B 33/04

[52] U.S. Cl. ..... 166/75.14; 166/115; 166/123; 166/208; 285/140

[58] Field of Search ..... 166/208, 182, 166/123, 382, 75.14, 115; 285/140, 917, 920

[56] References Cited

U.S. PATENT DOCUMENTS

| | | | |
|---|---|---|---|
| 4,665,979 | 5/1987 | Boehm, Jr. | 166/208 |
| 4,790,572 | 12/1988 | Slyker | 166/182 |
| 5,307,879 | 5/1994 | Kent | 166/382 |
| 5,333,692 | 8/1994 | Baugh et al. | 166/208 |
| 5,372,201 | 12/1994 | Milberger | 166/382 |

FOREIGN PATENT DOCUMENTS

| | | | |
|---|---|---|---|
| 2180016 | 3/1987 | United Kingdom . | |
| 2213178 | 8/1989 | United Kingdom . | |
| 2221484 | 2/1990 | United Kingdom | 166/208 |
| 2230803 | 10/1990 | United Kingdom . | |
| 2251012 | 6/1992 | United Kingdom . | |

*Primary Examiner*—Hoang C. Dang
*Attorney, Agent, or Firm*—Henry C. Query, Jr.

[57] ABSTRACT

A tubing hanger has an exterior surface and carries a seal arranged inwardly of this surface. The seal has two sealing portions and, when the hanger is located in a wellhead, the seal is engaged by an activating device operated by a piston to force one sealing portion into engagement with the tubing hanger and the other portion into engagement with the wellhead. The movement of the piston can be reversed to break the seals.

6 Claims, 3 Drawing Sheets

TUBING HANGER WITH HYDRAULICALLY ENERGIZED METAL ANNULAR SEAL WITH NEW DESIGN TUBING HANGER RUNNING TOOL

BACKGROUND OF THE INVENTION

The invention relates to tubing hangers.

A tubing hanger is used in a well, for example an oil well, to suspend a length of tubing within a casing. The tubing hanger, with the tubing suspended beneath it, is lowered into a wellhead at an upper end of the casing and locked to the wellhead.

It is necessary to provide a seal between the exterior surface of the tubing hanger and the wellhead so that the annular space between the tubing hanger and the wellhead is isolated. This allows the passage of fluids into and from this space.

It has previously been proposed to provide on the tubing hanger a seal which projects from the tubing hanger and which locates between the tubing hanger and the wellhead when the tubing hanger is locked to the wellhead. However, since the tubing hanger with the seal must be moved relatively to the wellhead into a position to be locked to the wellhead, the seal cannot engage the wellhead tightly since this would restrict such movement and might damage the seal.

SUMMARY OF THE INVENTION

According to the invention, there is provided a tubing hanger lockable in a wellhead and comprising an exterior surface and carrying an annular seal including two sealing portions and located radially inwardly of said outer surface, and a seal actuating device associated with the seal and movable relatively to the seal and the surface to urge one sealing portion into engagement with said surface and the other sealing portion into a position for engagement with a surface of the wellhead to form a seal between the tubing hanger and the wellhead.

By having a seal with movable sealing portions, the seal can be recessed relative to the tubing hanger surface and so does not interfere with the location of the tubing hanger into the wellhead.

BRIEF DESCRIPTION OF THE DRAWINGS

The following is a more detailed description of an embodiment of the invention, by way of example, reference being made to the accompanying drawings wherein:

FIG. 5 is a cross-section of a third embodiment of a seal according to the present invention; and.

DETAILED DESCRIPTION OF THE PREFERRED EMBODIMENTS

Figure 1:
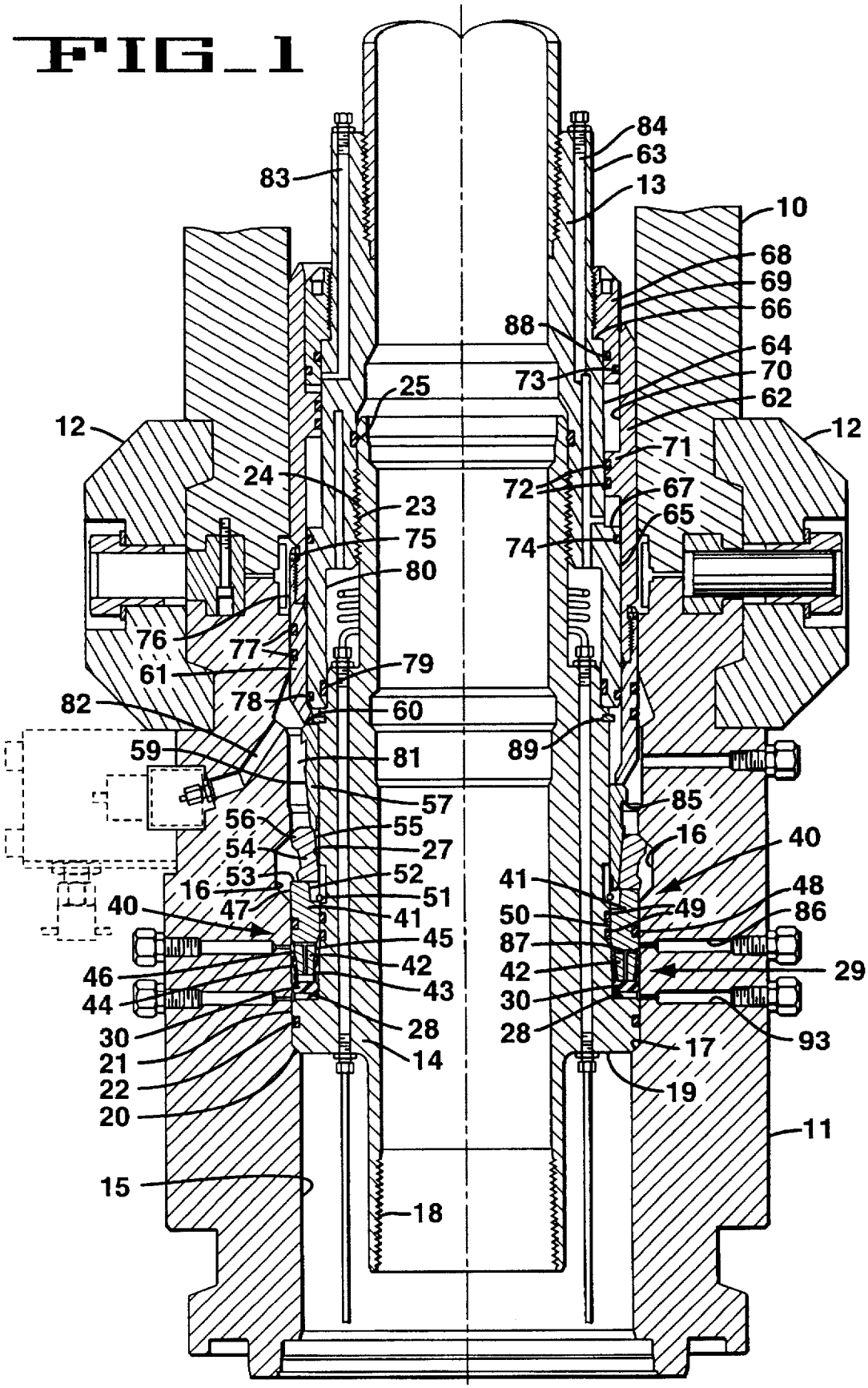
FIG. 1 is a cross section of a wellhead connected to an end of a riser and containing a tubing hanger connected to a running tool the left-hand side of the Figure showing the tubing hanger landed on the wellhead with a seal of the tubing hanger unset and with no lock between the tubing hanger and the wellhead and the right hand side of the Figure showing the seal set and the tubing hanger locked to the wellhead.

Referring first to FIG. 1, a riser 10 is connected to a tubing head or wellhead 11 by a conventional clamping system 12. A running tool 13 is shown located within the riser 10 and wellhead 11 and connected to a tubing hanger 14.

The wellhead 11 has an interior surface 15 provided with an annular locking recess 16 and, at a position spaced axially from the locking recess 16, an inwardly directed sloping annular shoulder 17. The tubing hanger 14 has, at its lower end, a threaded connecting portion 18 for engagement with tubing (not shown). This portion 18 terminates in an annular outwardly directed step 19 whose radially outermost end is provided with an angled shoulder 20 which engages the shoulder 17 on the wellhead 11 when the tubing hanger 14 is landed in the wellhead 11 by the running tool 13. This thus locates the tubing hanger 14 relative to the wellhead 11.

The exterior surface 21 of the tubing hanger 14 adjacent the shoulder 20 (which is the maximum diameter surface of the tubing hanger 14) is provided with an annular elastomeric seal 22 for engagement with the interior surface 15 of the wellhead 11 to provide a seal therebetween.

The tubing hanger 14 is provided at its upper end with a thread 23 which engages with a cooperating thread 24 on the running tool 13 to connect the tubing hanger 14 to the running tool 13. An annular elastomeric seal 25 on the interior of the running tool 13 engages the outer surface of the tubing hanger 14 adjacent the threads 23, 24 to form a seal therebetween.

The larger diameter exterior surface portion 21 of the tubing hanger 14 leading from the shoulder 20 is followed by a smaller diameter exterior surface portion 27; the two portions being connected by a radial step 28. An annular seal 29 extends around the smaller diameter exterior surface portion 27 and has a base 30 that rests on the step 28, so locating the seal 29 axially relative to the tubing hanger 14.

Figure 3:
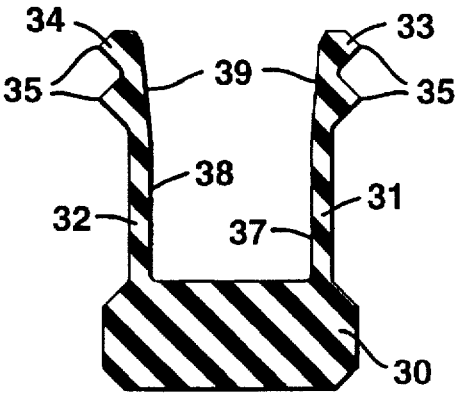
FIG. 3 is a cross-section of a first embodiment of a seal according to the present invention.
Figure 4:
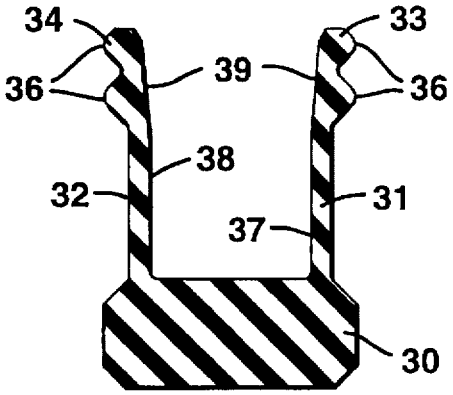
FIG. 4 is a cross-section of a second embodiment of a seal according to the present invention.
Figure 5:
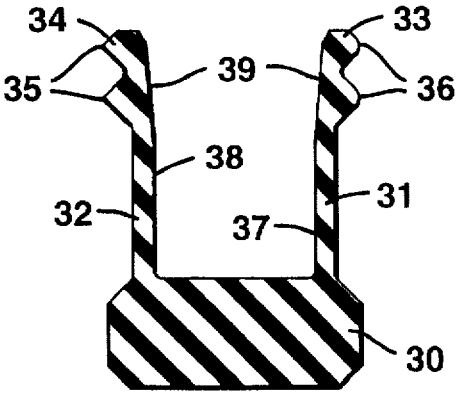

As best seen in FIGS. 3, 4 and 5, the base 30 of the seal carries a pair of radially spaced annular flanges 31, 32 projecting from the base in a generally axial direction. Each flange 31, 32 has, at an end remote from the base 30, an annular rib 33, 34 projecting radially in a direction away from the other flange 32, 31. The end of each rib 33, 34 remote from the associated flange 31, 32 carries a sealing formation. Various configurations of sealing formation are possible and some configurations are shown in FIGS. 3, 4 and 5.

In FIG. 3, the radially inner rib 33 carries spikes 35 while similar spikes are also provided on the radially outer rib 34. In FIG. 4, the radially inner rib 33 carries bumps 36 which are of generally semi-spherical shape while similar bumps 36 are provided on the radially outer rib 34. In the seal of FIG. 5, the radially inner rib 33 carries bumps 36 and the radially outer rib 34 carries spikes 35. These various configurations of sealing formations are designed for use in different circumstances, which will be discussed below.

Each flange 31, 32 includes an inner wall 37, 38 respectively. At their lower ends, the walls 37, 38 are parallel but at the ends of the walls 37, 38 adjacent the ribs 33, 34, each wall is provided with an outwardly directing locking taper 39.

Figure 2:
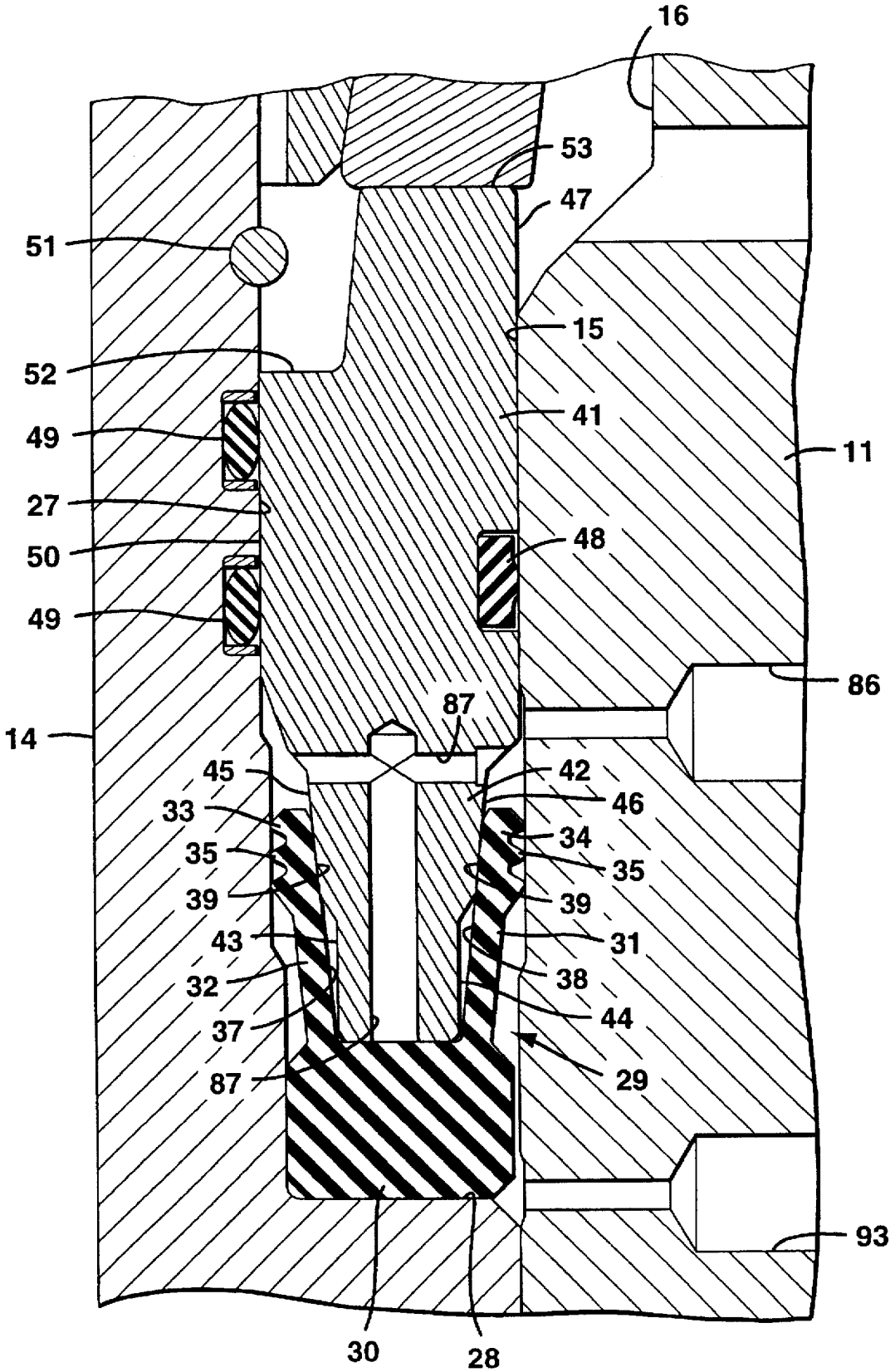
FIG. 2 is a cross-sectional view of a part of the assembly of FIG. 1, showing a seal arranged between the wellhead and the tubing hanger and sealed with these parts by a seal energizing device.

The function of these tapers 39 will be described below. Referring again to FIG. 1, a seal energizing device indicated generally at 40 extends around the smaller diameter exterior surface portion 27 just above the seal 29. The device 40 is shown in more detail in FIG. 2 and comprises an annular piston 41 and an annular energizing member 42 projecting downwardly from the piston 41 and located between the inner walls 37, 38 of the flanges 31, 32 of the seal 29. The member 42 has inner and outer surfaces 43, 44 which are cylindrical at their lower ends but which are provided with respective locking tapers, 45, 46 respectively, at their upper ends with the tapers 45, 46 being complementary to the tapers 39 on the walls 37, 38. As seen to the left of FIG. 1, before seal is set, only the cylindrical portions of the inner and outer surfaces, 43, 44 extend between the walls 37, 38.

The piston 41 has a radially outer surface 47 carrying an annular elastomeric seal 48 which engages the inner surface 15 of the wellhead 11 to form a seal therebetween. The smaller diameter exterior surface portion 27 of the tubing hanger 14 carries a pair of annular elastomeric seals 49 which engage a radially inner surface 50 of the piston 41 to form a seal therebetween.

In the position of the piston 41 shown in the left hand side of FIG. 1, the piston 41 is in an upwardly retracted position and its movement in this direction is limited by engagement between a circlip 51 carried by the tubing hanger surface 27 and a step 52 in the inner surface 50 of the piston 41. The movement of the piston 41 from this retracted position will be described below.

The piston 41 also has an upper end 53 on which rests a lock ring 54 which has a radially inner surface 55 provided with a locking taper and a radially outer surface provided with two annular projections 56. The lock ring 54 carries an energizing ring 57 with an outer surface having a lower end provided with a locking taper 59 complementary to the taper of the inner surface 55 of the lock ring 54. The energizing ring 57 has an upper end surface 60 that bears against an end of a running tool adapter 61 associated with a running tool piston 62 carried by the running tool 13. This assembly will now be described in more detail.

The running tool 13 is provided with three successive exterior surface portions 63, 64, 65 of progressively increasing diameters from the upper end of the running tool 13 and interconnected by respective steps 66, 67. The smallest diameter surface 63 is threaded adjacent the associated step 66 and engages a complementary thread on a collar 68 which has an annular outer surface 69 spaced radially outwardly of the intermediate surface portion 64 of the running tool and axially aligned with the larger diameter exterior surface portion 65. The running tool piston 62 has an interior surface 70 which engages the collar outer surface 69 and the larger diameter exterior surface portion 65, to guide the running tool piston in axial sliding movement. The interior surface 70 of the running tool piston 62 has a radially inwardly projecting annular land 71 engaging the intermediate diameter exterior surface portion 64 to divide the chamber formed between the collar 68, the step 67, the intermediate exterior surface portion 64 and the interior surface 70 of the running tool piston 62, into two portions which are isolated from one another by two annular elastomeric seals 72 carried by the land 71 and engaging the intermediate exterior surface portion 64.

The chamber is also sealed by an annular elastomeric seal 73 carried by the outer surface 69 of the collar 68 and engaging the interior surface 70 of the running tool piston 62 and an annular elastomeric seal 74 carried by the larger diameter exterior surface portion 65 and engaging the interior surface 70, of the running tool piston 62. There is also an annular elastomeric seal 88 carried by an inner surface of the collar 68 and engaging the exterior surface portion 64 of the running tool 13.

The lower end of the running tool piston 62 is in threaded engagement with the running tool adapter 61 with grub screws 75 carried by the running tool adapter 61 and engaging the running tool piston 62 to lock the parts together. The running tool adapter 61 has an outer surface 76 which carries a pair of annular elastomeric seals 77 which, in the position of the adapter 61 shown to the left hand side of FIG. 1, engage the interior surface 15 of the wellhead 11. There is also an annular elastomeric seal 78 carried by the larger diameter exterior surface portion 65 of the running tool 13 and engaging an inner surface of the running tool adapter 61 and an annular elastomeric seal 79 carried by an inner surface 80 of the running tool 13 at its lower end and engaging the tubing hanger 14. The presence of these seals 77, 78 and 79, provides a closed chamber 81 between those seals and the piston 41. A passage 82 leads from the chamber 81 through the wellhead 11 for connection to a source of fluid under pressure (not shown).

A tool control line 83 extends axially through the running tool 13 from the upper end to the upper portion of the chamber formed by the running tool piston 62. A return control line 84 leads from the lower portion of the chamber formed by the running tool piston 62 to the upper end of the running tool 13. The function of these lines 83, 84 will be described below.

In use, the riser 10 is clamped to the wellhead 11 in conventional fashion using the clamping system 12.

Prior to use offshore, an appropriate seal 29 is passed onto the tubing hanger 14 to rest on the step 28. The form of seal 29 chosen depends on the type of wellhead with which the tubing hanger is to be used. The seal of FIG. 3 is used where the wellhead has been in service for some time and the interior surface 15 of the wellhead 11 and the smaller diameter exterior surface 27 of the tubing hanger 14 have been in service for some time. In this case, these surfaces may be corroded or be damaged caused by repeated installation and removal of tubing hangers 14. The spikes 35 on the two flanges 31, 32 bite into these surfaces and provide a secure seal.

The seal 29 of FIG. 4 is used where both the tubing hanger 14 and the wellhead 11 are previously unused. The bumps 36 are able to provide a good seal with previously unused surfaces.

The seal 29 of FIG. 5 is for use where the tubing hanger is unused but where the wellhead 11 has been subject to workover. The spikes 35 provide a good seal on the workedover wellhead 11 while the bumps 36 provide a good seal on the tubing hanger surface 27 and also prevent damage to the seals 49 on the surface portion 27 as the seal 29 is removed from the tubing hanger 14.

After an appropriate seal 29 is located on the step 28, the seal energizing device 40 is slid onto the surface portion 27 of the tubing hanger 14 until the cylindrical surfaces 43, 44 of the member 42 engage between the walls 37, 38 of the flanges 31, 32 of the seal 29. The circlip 51 is engaged with the tubing hanger 14 to limit the upward movement of the assembly 40. This is the position of the assembly 40 shown to the left hand side of FIG. 1.

The lock ring 54 is then slid over the tubing hanger until it engages with the upper end surface 53 of the piston 41. The energizing ring 57 is then slid over the tubing hanger 14 until it rests on the lock ring 54. A retainer ring 89 is then located in a groove on the tubing hanger 14 above the energizing ring 57 to limit upward movement of the ring 57. The running tool 13 is then threaded onto the tubing hanger 14 via the threads 23, 24 to connect the two together. The running tool piston 62 is in its uppermost position as shown to the left hand side of FIG. 1 and, when so positioned, and when the running tool 13 is engaged with the tubing hanger 14, the lower end of the running tool adapter 61 engages the upper end of the energizing ring 57.

To set the seal 29, fluid under pressure is supplied through the passage 82 into the chamber 81. This causes axial downward movement of the piston 41 so forcing the member 42 between the flanges 31, 32 of the seal 29. This brings the locking tapers 45, 46 of the member 42 into engagement with the locking tapers 39 of the inner walls 37, 38. This causes the flanges 31, 32 to be splayed outwardly of the base 30 and into sealing engagement with the exterior surface 27 of the tubing hanger 14 and the interior surface 15 of the wellhead 11, respectively. The spikes 35/bumps 36 are forced into engagement with the surfaces. This is the position shown in FIG. 2.

An alternative method of setting the seal 30 is to pressurize the void between the riser 10 and the running tool 13 above the wellhead 11. This can be used if the seals around the running tool 13 and the running tool piston 62 fail.

After the seal 29 has been set, the pressure can be released since the locking tapers 39, 45, 46 maintain the seal 29 engaged with the member 42 (as does the lock ring 41 in a manner described below).

The integrity of the seal can be tested by passing fluid under pressure through a passage 93 extending radially through the wellhead 11 and emerging at a point on the inner surface of the wellhead 11 level with the radial step 28. Any leakage can be detected by the flow of fluid through a second passage 86 extending radially through the wellhead from a point on the inner surface of the wellhead 11 adjacent the lower end of the piston 41 i.e. on the opposite side of the seals to the passage 93).

This downward movement of the piston 41 also causes downward movement of the lock ring 54 (since the lock ring rests on the piston 41). The lock ring 54 thus moves from the position shown to the left of FIG. 1 to the position shown to the right of FIG. 1 where the lock ring 54 is aligned with the locking recess 16 in the wellhead 11. Next, fluid under pressure is supplied to the upper portion of the chamber formed by the running tool piston 62, via the control line 83, to force the running tool piston 62 downwardly. This in turn moves the running tool adapter 61 downwardly and the energizing ring 57 downwardly. The tapered surface 59 of the energizing ring 57 is thus forced behind the lock ring 54 and into engagement with a corresponding taper 55 on the inner surface of the lock ring 54. The lock ring 54 is thus pushed radially outwardly into the locking recess 16 to lock the tubing hanger 14 to the wellhead 11. This is the position shown to the right-hand side of FIG. 1. Since the lock ring 54 bears on the piston 41, the radial outward movement of the lock ring 54 (which is also accompanied by downward axial movement of the lock ring 54) will apply additional downward load to the piston 41 so reinforcing the sealing effect of the seal 29.

After the lock ring 54 has been so engaged, the running tool piston 62 can be retracted by the supply of fluid under pressure, via the control line 84, to the lower portion of the chamber formed by the running tool piston 62. This causes the running tool piston 62 to move upwardly and retract the running tool adapter 61. The running tool 13 can then be unscrewed from the tubing hanger and retracted to the surface.

The lock ring 54 is released and the seal 29 can be unset in the following way.

Figure 6:
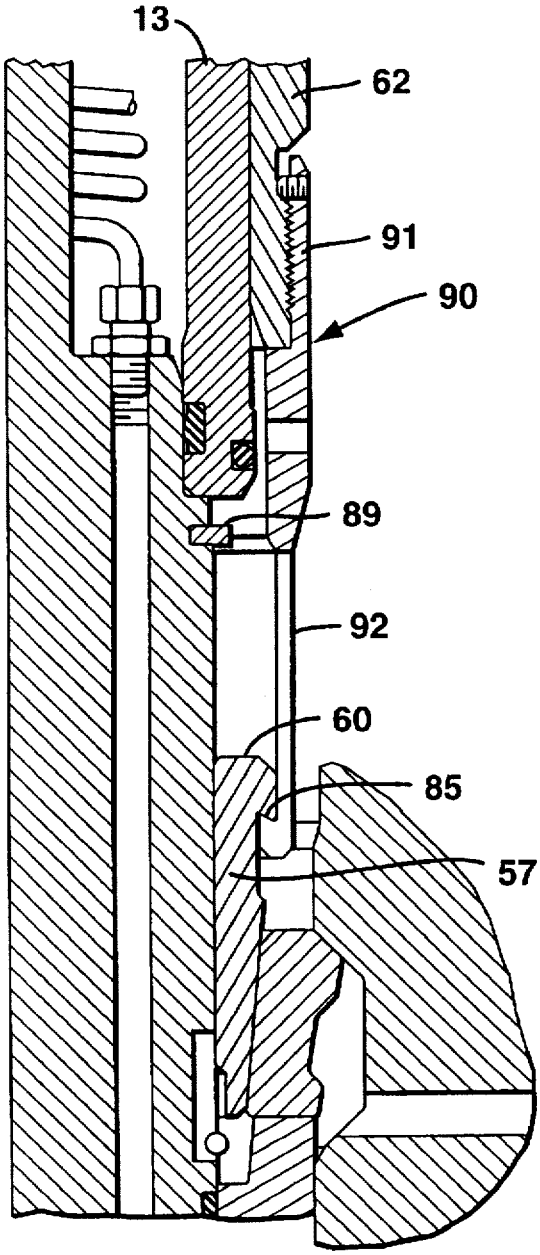
FIG. 6 is a partial cross-sectional view of the running tool of FIG. 1, carrying a retrieval adapter.

First, the running tool adapter 61 is removed from the running tool 13 and replaced by a retrieval adapter 90 (see FIG. 6). With reference to that Figure, the retrieval adapter 90 comprises an annular body 91 threaded on the running tool 13 and a plurality of downwardly projecting fingers 92. The running tool 13 is lowered to the wellhead 11 and threaded onto the tubing hanger 14, as described above. When the running tool piston 62 is moved as described above from the retracted position, shown to the left of FIG. 1, to the extended position shown to the right of FIG. 1, the fingers 92 engage in an annular downwardly and outwardly directed step 85 provided around the outer surface of the energizing ring 57 (see FIG. 6). The running tool piston 62 can then be moved back to the retracted positon to pull the energizing ring 57 out from behind the lock ring 54 and so allow the lock ring 54 to move under its own resilience back to the retracted position shown to the left of FIG. 1. Fluid under pressure can then be supplied through the passage 86 passing through the wellhead 11 and emerging in the space below the piston 41 and above the seal 29. This fluid passes through passages 87 in the member 42 and acts on the undersurface of the piston 41 to retract the piston 41 from the position shown to the right of FIG. 1 to the position shown to the left of FIG. 1, with the retraction being limited by the circlip 51. This disengages the tapers 39, 45, 46 and allows the flanges 31, 32 to retract under their own resilience so disengaging the spikes 35/bumps 36 from the associated surfaces 15, 27.

Once this has been done, the running tool 13 can be retracted to the surface to draw the tubing hanger 14 to the surface.

It will be appreciated that the arrangement need not be as described above. Although the seal 29 has been described as having a base 30 and two flanges 31, 32, it could have any suitable shape that provides two sealing portions that can be separated to bring them into engagement with respective sealing surfaces. This movement need not be by the seal energizing assembly 40 described above; it could be by any suitable assembly such as a wedge block.

The outside diameter of the seal 29 is less than the diameter of the larger diameter exterior surface 26 of the tubing hanger 14. This offers protection of the seal during running and prevents damage of elastomer seals during retrieval. Any pressure end load from below causing deflection (due to material compressibility) will tend to drive the member 42 further into the seal 29 to increase the sealing effect.

What is claimed is:

1. A tubing hanger locatable in a wellhead and comprising:

an exterior surface including a reduced diameter portion;

an annular seal located on the reduced diameter portion and including two sealing portions;

a seal actuating device associated with the seal and movable relatively to the seal and the exterior surface to urge one sealing portion into engagement with the exterior surface and the other sealing portion into engagement with a surface of the wellhead to form a seal between the tubing hanger and the wellhead;

wherein the seal comprises an annular base and a pair of radially spaced annular flanges projecting from the base in a generally axial direction, each flange forming a respective sealing portion, the seal actuating device being insertable between said flanges to urge said sealing portions into said respective engagements;

wherein the seal actuating device includes an annular piston movable axially relative to the exterior surface and in sealing engagement therewith, the piston also being in sealing engagement with the wellhead so that fluid pressure applied to a radially extending annular surface of the piston causes axial movement of the seal actuating device to engage said sealing portions; and further comprising a running tool connected to said tubing hanger, said running tool having an annular seal for engagement with the wellhead at a position axially spaced from said piston to define, with the tubing hanger and the wellhead, a chamber which can be pressurized to move said piston.

2. A tubing hanger according to claim 1, wherein a lock ring is provided, the running tool including means for moving said lock ring radially outwardly for engagement with the wellhead to lock the tubing hanger to the wellhead.

3. A tubing hanger according to claim 2, wherein the lock ring engages the piston and moves axially downwardly while moving radially outwardly to engage the wellhead, said axial movement applying additional load to the piston to maintain said seal.

4. A tubing hanger according to claim 2, wherein the running tool carries said lock ring moving means.

5. A tubing hanger according to claim 4 wherein said lock ring moving means comprises an annular piston on the running tool actualable to move axially along the running tool to move said lock ring.

6. A tubing hanger according to claim 5, wherein the running tool piston engages a head of an energizing ring, the energizing ring including a portion which is spaced from said head, which is tapered, and which engages behind said lock ring to convert axial movement of the running tool piston into radially outward locking movement of the lock ring.

* * * * *